US008224564B2

(12) United States Patent
Ogasawara et al.

(10) Patent No.: US 8,224,564 B2
(45) Date of Patent: Jul. 17, 2012

(54) VEHICLE DRIVE ASSIST SYSTEM

(75) Inventors: Toyokazu Ogasawara, Tokyo (JP); Yuichiro Tsukasaki, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 1031 days.

(21) Appl. No.: 12/155,927

(22) Filed: Jun. 11, 2008

(65) Prior Publication Data

US 2009/0037052 A1 Feb. 5, 2009

(30) Foreign Application Priority Data

Jun. 12, 2007 (JP) ..... 2007-155635

(51) Int. Cl.
*G08G 1/16* (2006.01)

(52) U.S. Cl. ..... 701/301

(58) Field of Classification Search ..... 701/41, 701/78, 200, 210, 301; 188/350; 180/6.2, 180/410

See application file for complete search history.

(56) References Cited

U.S. PATENT DOCUMENTS 6,926,374 B2 * 8/2005 Dudeck et al. ..... 303/191
7,069,146 B2 * 6/2006 Yamamura et al. ..... 701/301
7,200,481 B2 * 4/2007 Yamamura et al. ..... 701/96
7,613,568 B2 * 11/2009 Kawasaki ..... 701/301
7,630,818 B2 * 12/2009 Kobayashi et al. ..... 701/96
2005/0065687 A1 * 3/2005 Hijikata et al. ..... 701/41
2007/0272464 A1 * 11/2007 Takae et al. ..... 180/169

FOREIGN PATENT DOCUMENTS

JP 2004-110346 4/2004

* cited by examiner

*Primary Examiner* — Mary Cheung
*Assistant Examiner* — Kyle K Tsui
(74) *Attorney, Agent, or Firm* — Smith, Gambrell & Russell, LLP

(57) ABSTRACT

A control unit sets a current total risk function for each of white lines, guardrails, side walls, and three-dimensional objects existing around a vehicle, estimates a temporal change in the position of each object, and calculates a minimum of the total risk function at the vehicle position for each time. An objective function is generated for the time, and a turning control amount that minimizes the objective function at the time is calculated as a turning control amount of the vehicle. Risk functions provided when the vehicle moves by the turning control amount are set for respective routes. A final avoidance route is selected from the risk functions of the routes, and steering and braking are controlled.

8 Claims, 7 Drawing Sheets

VEHICLE DRIVE ASSIST SYSTEM

CROSS-REFERENCES TO RELATED APPLICATIONS

The disclosure of Japanese Patent Application No. 2007-033893 filed on Feb. 14, 2007 and No. 2007-155635 filed on Jun. 12, 2007 including the specification, drawings and abstract is incorporated herein by reference in it entirety.

BACKGROUND OF THE INVENTION

1. Field of the Invention

The present invention relates to a vehicle drive assist system that sets risks for white lines and three-dimensional objects existing around a vehicle and detected, for example, by a stereo camera, a monocular camera, or a millimeter-wave radar and that controls steering or braking so that the vehicle can take an optimum route.

2. Description of the Related Art

In recent years, various technologies of improving safety of a vehicle have been developed and practically used. In these technologies, a traveling environment in front of the vehicle is detected, for example, by a camera or a laser radar mounted in the vehicle. On the basis of data on the traveling environment, obstacles and a preceding vehicle are recognized, and alerting, automatic braking, and automatic steering are performed.

For example, in a technology disclosed in Japanese Unexamined Patent Application Publication No. 2004-110346, an obstacle existing around a vehicle is detected, and the current risk potential of the vehicle to the obstacle is calculated. On the basis of the risk potential, the operation of vehicle equipment is controlled so as to urge the driver to perform a driving operation concerning the motion of the vehicle in the front-rear and right-left directions. The operation of the vehicle equipment is controlled in only one of the front-rear direction and the right-left direction.

However, the control disclosed in the above publication is performed strictly in accordance with the current risk potential, and therefore, cannot effectively respond to the risk that varies with movements of the vehicle and the obstacle. In other words, even in a path that is considered optimal at present, the risk will frequently increase in the future.

SUMMARY OF THE INVENTION

The present invention has been made in view of the above-described circumstances, and an object of the invention is to provide a vehicle drive assist system that sets the current and future risks with accurate consideration of the relative movement between a vehicle and an obstacle, and that performs control so that the vehicle can more naturally run along an optimum route so as to improve safety.

A vehicle drive assist system according to a first aspect of the present invention includes an ambient-environment recognizing means for recognizing an ambient environment of a vehicle; a risk setting means for setting the current risk from an object in the recognized ambient environment; a risk-change predicting means for predicting a temporal change in the corrected risk by predicting a temporal change in a position of the object; a minimum calculating means for calculating the minimum of the risk at a position of the vehicle at each time on the basis of the predicted temporal change in the risk; a turning-control-amount calculating means for calculating a turning control amount of the vehicle on the basis of at least the minimum; and an avoidance-route determining means for determining a final avoidance route by generating an avoidance route of the vehicle on the basis of the turning control amount.

A second aspect of the present invention according to the first aspect of the present invention, further includes at least one of:

steering control means for controlling steering on the basis of the turning control amount of the vehicle in the final avoidance route; and brake control means for controlling braking on the basis of the risk in the final avoidance route.

A third aspect of the present invention according to the first aspect of the present invention, the turning-control-amount calculating means forms an objective function at each time on the basis of a deviation between a lateral position of the vehicle and the minimum and the turning control amount at the time, and calculates, as the turning control amount of the vehicle, a turning control amount that minimizes the objective function at the time.

A fourth aspect of the present invention according to the first aspect of the present invention, the minimum calculating means calculates the minimum of the risk by partial differentiation in a width direction of the vehicle.

A fifth aspect of the present invention according to the first aspect of the present invention, when the object is a white line, the risk setting means sets the risk so as to increase from about the center of a driving lane toward the white line.

A sixth aspect of the present invention according to the first aspect of the present invention, when the object is a three-dimensional object, the risk setting means sets the risk in a probability distribution.

A seventh aspect of the present invention according to the first aspect of the present invention, further includes risk correcting means for correcting the current risk set by the risk setting means in accordance with at least one of a relative speed and a relative acceleration between the object and the vehicle.

An eighth aspect of the present invention according to the seventh aspect of the present invention, the risk correcting means corrects the current risk set by the risk setting means in accordance with the relative acceleration between the object and the vehicle so that the current risk increases as the relative acceleration increases in a direction in which the object approaches the vehicle.

According to the vehicle drive assist system of the present invention, it is possible to set not only the current risk, but also future risks. This allows the vehicle to be controlled so as to take an optimum route with higher safety.

DESCRIPTION OF THE PREFERRED EMBODIMENT

An embodiment of the present invention will be described below with reference to FIGS. 1 to 7.

Figure 1:
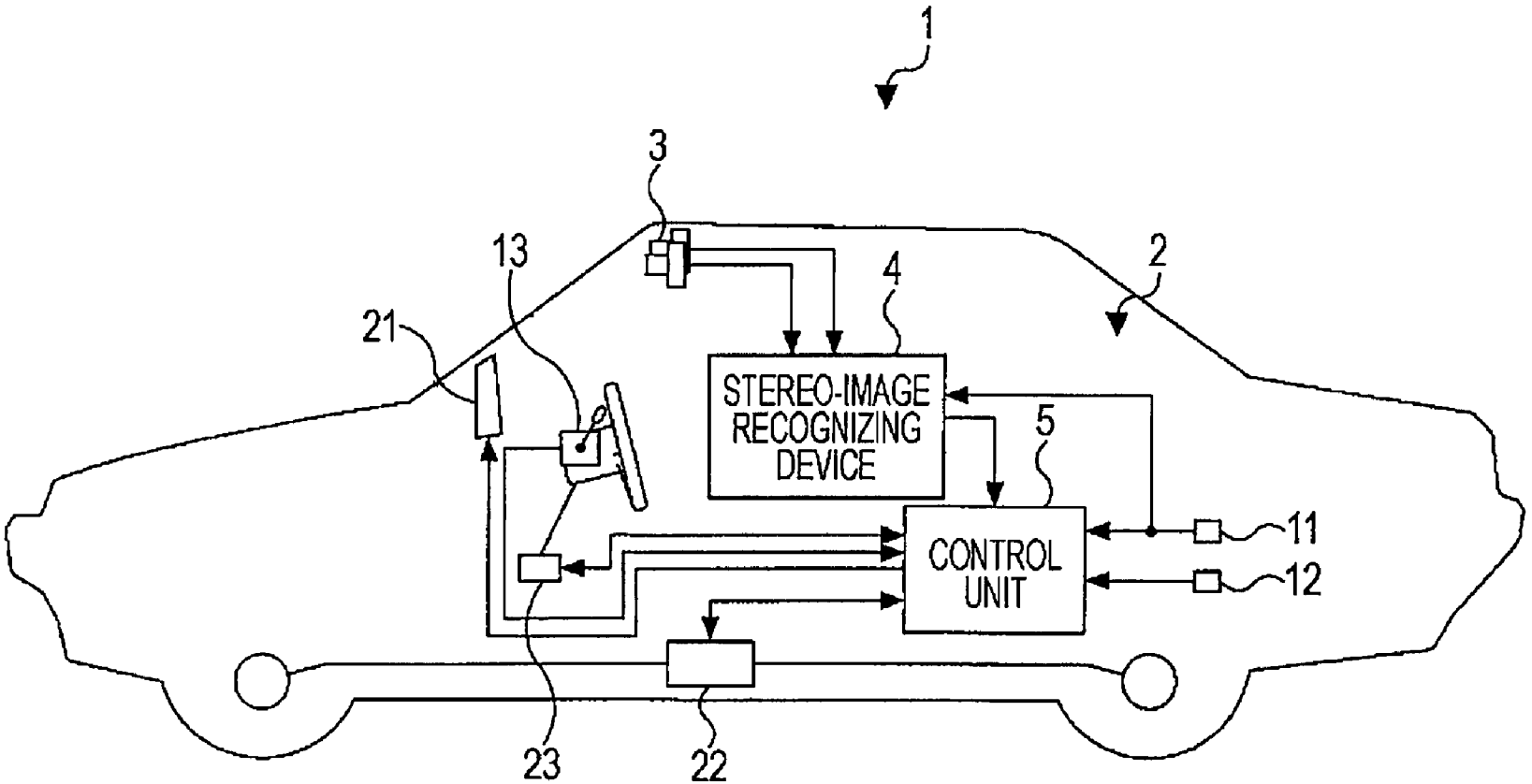
FIG. 1 is a schematic view showing the configuration of a drive assist system installed in a vehicle.

Referring to FIG. 1, a drive assist system 2 is installed in a vehicle (driver's own vehicle) 1 such as a car. The drive assist system 2 mainly includes a stereo camera 3, a stereo-image recognizing device 4, and a control unit 5.

The vehicle 1 is also provided with a vehicle speed sensor 11 for detecting the vehicle speed V, a yaw-rate sensor 12 for detecting the yaw rate (dϕ/dt), and a main switch 13 to which an ON/OFF signal for drive assist control is input. The vehicle speed V is input to the stereo-image recognizing device 4 and to the control unit 5. The yaw rate (dϕ/dt) and the ON/OFF signal for drive assist control are input to the control unit 5.

The stereo camera 3 serves as a stereo optical system, and includes a pair of (right and left) CCD cameras each using a solid-state image sensor such as a charge coupled device (CCD). The right and left CCD cameras are mounted in the front of a ceiling in the vehicle interior in a manner such as to be arranged with a predetermined space therebetween. The CCD cameras take stereo images of outside objects from different viewpoints, and input data on the images to the stereo-image recognizing device 4.

For example, images from the stereo camera 3 are processed in the stereo-image recognizing device 4 in the following manner. First, distance information is calculated from the amount of misalignment between the corresponding positions in a pair of stereo images taken in the advancing direction of the vehicle 1 by the stereo camera 3, and a distance image is generated on the basis of the distance information. This image data is subjected to known grouping, and is compared with windows of prestored three-dimensional data, such as road shape data, side wall data, and three-dimensional object data. As a result of comparison, white line data and side wall data on guardrails and curbs extending along the road are extracted, and three-dimensional objects are extracted in classes of a two-wheeled vehicle, a standard-sized vehicle, a large-sized vehicle, a pedestrian, an electric pole, and other three-dimensional objects.

In the above-described recognized data, the positions of objects are calculated in a coordinate system in which the position of the vehicle 1 is the origin, the X-axis indicates the front-rear direction of the vehicle 1, and the Y-axis indicates the width direction of the vehicle 1. In particular, the lengths in the front-rear direction of a two-wheeled vehicle, a standard-sized vehicle, and a large-sized vehicle are respectively estimated, for example, at 3 m, 4.5 m, and 10 m beforehand. Further, the current widthwise center position of the vehicle is calculated from the center position of the detected width and is represented in coordinates ($x_{obstacle}$, $y_{obstacle}$) . When the length of the vehicle in the front-rear direction can be precisely detected, for example, by vehicle-to-vehicle communication, the above-described center position may be calculated from data on the length in the front-rear direction.

In three-dimensional object data, the relative speed Vs with respect to the vehicle 1 is calculated on the basis of changes in the distance from the vehicle 1 in the X-axis and Y-axis directions. By using the relative speed Vs and the vehicle speed V of the vehicle 1 with consideration of the vector quantity, the X-axis direction speed and Y-axis direction speed (v $x_{obstacle}$, v $y_{obstacle}$) of the three-dimensional object are calculated.

Information thus obtained, that is, white line data, side wall data on guardrails and curbs extending along the road, and three-dimensional object data (type, distance from the vehicle 1, center position ($x_{obstacle}$, $y_{obstacle}$), speed (v $x_{obstacle}$, v $y_{obstacle}$), and relative speed Vs with respect to the vehicle 1) are input to the control unit 5. In this way, the stereo camera 3 and the stereo-image recognizing device 4 are provided as ambient-environment recognizing means in this embodiment.

The control unit 5 receives the vehicle speed V from the vehicle speed sensor 11, the yaw rate (dϕ/dt) from the yaw-rate sensor 12, and white line data, side wall data on guardrails and curbs extending along the road, and three-dimensional object data (type, distance from the vehicle 1, center position ($x_{obstacle}$, $y_{obstacle}$) , speed (v $x_{obstacle}$, v yobstacle), and relative speed Vs with respect to the vehicle 1) from the stereo-image recognizing device 4. On the basis of the above-described input data signals, the control unit 5 sets, as a risk function $R_{line}$ or $R_{obstacle}$, the current risk for each of the objects existing in front of the vehicle 1, such as white lines, guardrails, side walls, and three-dimensional objects, according to a drive assist control program that will be described below. In this case, the current risk $R_{obstacle}$ for a three-dimensional object is corrected so as to increase as the relative speed Vs increases in a direction in which the three-dimensional object approaches the vehicle 1, and so as to increase as the relative acceleration (dVs/dt) increases in the direction the three-dimensional object approaches the vehicle 1. On the basis of these risk functions $R_{line}$ and $R_{obstacle}$ (corrected values), the current total risk function R is set. Subsequently, a temporal change in the position of each object with the total risk function R set is predicted, and a temporal change in the total risk function R is thereby predicted. On the basis of the temporal change in the total risk function R, minimums $y_{min}$ (x,t) in the Y-axis direction at the vehicle at times are calculated. Further, objective functions J at the times are obtained from deviations between the lateral positions of the vehicle 1 and the minimums $Y_{min}$(x,t) and turning control amounts u(t) at the times. A turning control amount u(t) that minimizes the objective function J is calculated as a turning control amount u(t) of the vehicle 1 at the time. Risk functions R(t) provided when the vehicle 1 moves by the turning control amount u(t) are set for respective routes, and a final avoidance route R(t)f is selected from the risk functions R(t) of the routes. On the basis of the turning control amount u(t) in the final avoidance route R(t)f, a control signal is output to an automatic steering control device 23 serving as a steering control means so as to perform steering control. Further, on the basis of the final avoidance route R(t)f, a signal is output to an automatic brake control device 22 serving as a brake control means so as to perform brake control. When the signals are output to the automatic brake control device 22 and the automatic steering control device 23, they are visually displayed on a display 21 so as to be informed to the driver. In other words, the control unit 5 functions as a risk setting means, a risk correcting means, a risk-change predicting means, a minimum calculating means, a turning-control-amount calculating means, and an avoidance-route determining means.

Figure 2:
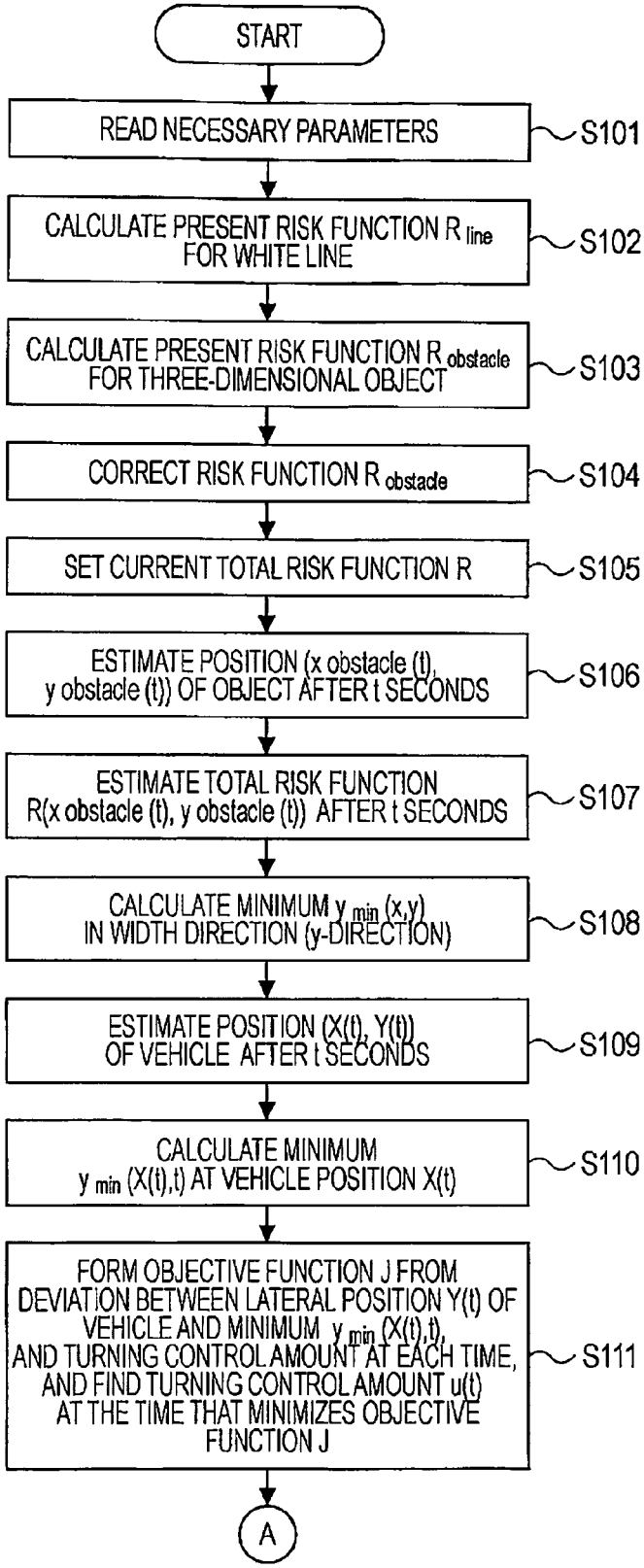
FIG. 2 is a flowchart showing a drive assist control program.
Figure 3:
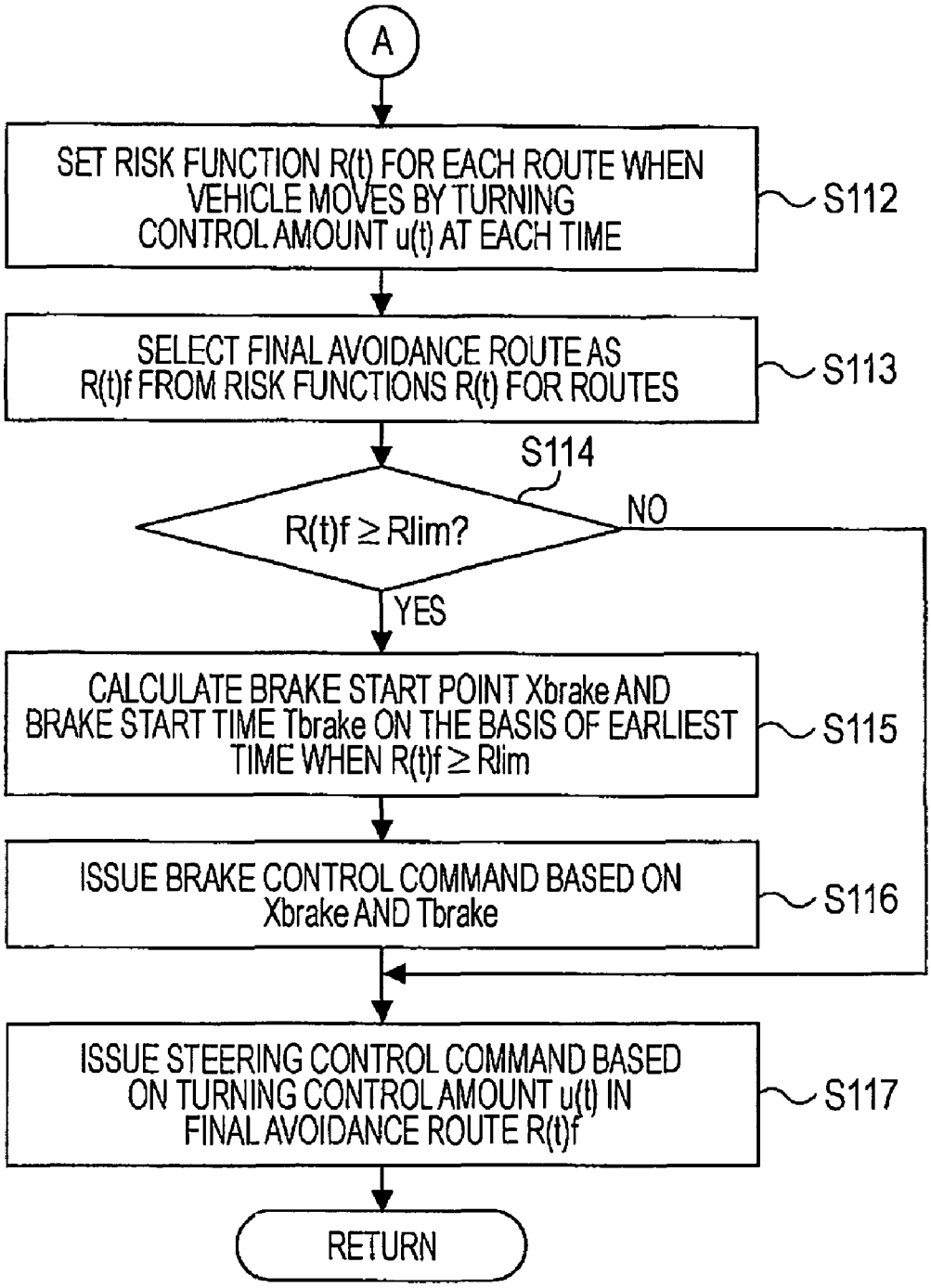
FIG. 3 is a flowchart showing a continuation of the drive assist control program shown in FIG. 2.

A drive assist control program executed by the drive assist system 2 will now be described with reference to FIGS. 2 and 3 serving as flowcharts.

First, in Step (hereinafter abbreviated as "S") 101, necessary parameters, more specifically, white line data, side wall data on guardrails and curbs extending along the road, and three-dimensional object data (type, distance from the vehicle 1, center position ($x_{obstacle}$, $y_{obstacle}$) , speed (v $x_{obstacle}$, v $y_{obstacle}$) , and relative speed Vs with respect to the vehicle 1) are read.

Figure 5:
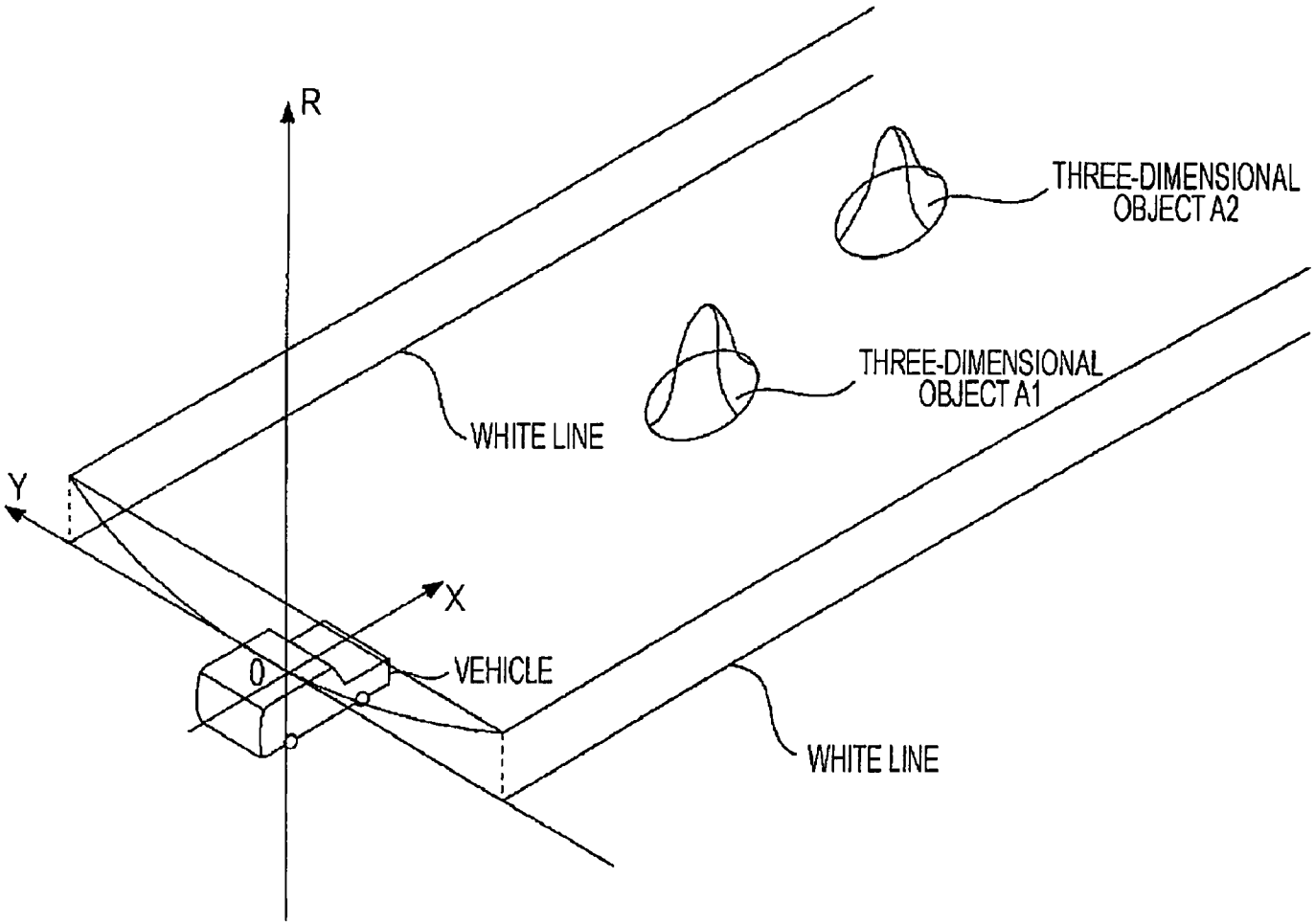
FIG. 5 is an explanatory view showing an example of a risk function set in front of a vehicle.

In S102, the current risk function $R_{line}$ for white lines (guardrails and side walls will be equally treated) is calculated by the following expression (1):

$$R_{line}=K_{line}\cdot y^2 \quad (1)$$

where $K_{line}$ represents a preset gain. That is, the current risk function $R_{line}$ for white lines is given as a quadratic function that has a center axis at the center of a driving lane defined by right and left white lines (guardrails and side walls will be equally treated), as shown in FIG. 5. While the risk function $R_{line}$ is a quadratic function in this embodiment, it may be any function that allows the risk to increase from the center of the driving lane toward the white lines. For example, the risk function $R_{line}$ may be a quartic or sextic function. Further, while a guardrail and a side wall are equally treated and are provided with a quadratic risk function $R_{line}$ in this embodiment, a function different from the risk function $R_{line}$ for white lines may be provided for guardrails and side walls so as to derive a risk higher than the risk for white lines. For example, when the risk function $R_{line}$ for the right and left white lines is given as a quadratic function, the function for guardrails and side walls may be changed to a quartic or sextic function. Even when a quadratic function is similarly used, the gain $K_{line}$ may be changed to a larger value. Moreover, the risk function $R_{line}$ for white lines is not limited to a function having a center axis at the center of the traveling lane, and the risk value may be made different between the right and left lines by offsetting the center axis.

In S103, the current risk function $R_{obstacle}$ for three-dimensional objects (a two-wheeled vehicle, a standard-sized vehicle, a large-sized vehicle, a pedestrian, an electric pole, and other three-dimensional objects) is calculated by the following expression (2):

$$R_{obstacle}=K_{obstacle}\cdot\exp(-((x_{obstacle}-x)^2/(2\cdot\sigma x_{obstacle}^2))-((y_{obstacle}-y)^2/(2\cdot\sigma y_{obstacle}^2))) \quad (2)$$

where $K_{obstacle}$ represents a preset gain, $\sigma x_{obstacle}$ represents a preset dispersion of the object in the X-axis direction, and $\sigma y_{obstacle}$ represents a preset dispersion of the object in the Y-axis direction. These dispersions $\sigma x_{obstacle}$ and $\sigma y_{obstacle}$ may be set to increase as the recognition accuracy of the stereo camera 3 decreases. Further, the dispersions $\sigma x_{obstacle}$ and $\sigma y_{obstacle}$ may be set so as to be standard when the object is a standard-sized vehicle or a large-sized vehicle, be large when the object is a pedestrian or a two-wheeled vehicle, and be small when the object is another three-dimensional object. Alternatively, the dispersions $\sigma x_{obstacle}$ and $\sigma y_{obstacle}$ may be set in accordance with the lap rate in the width direction between the vehicle 1 and the target three-dimensional object. In FIG. 5, a three-dimensional object A1 and a three-dimensional object A2 show examples of current risk functions $R_{obstacle}$ for three-dimensional objects that are calculated by the above-described expression (2).

Figure 4:
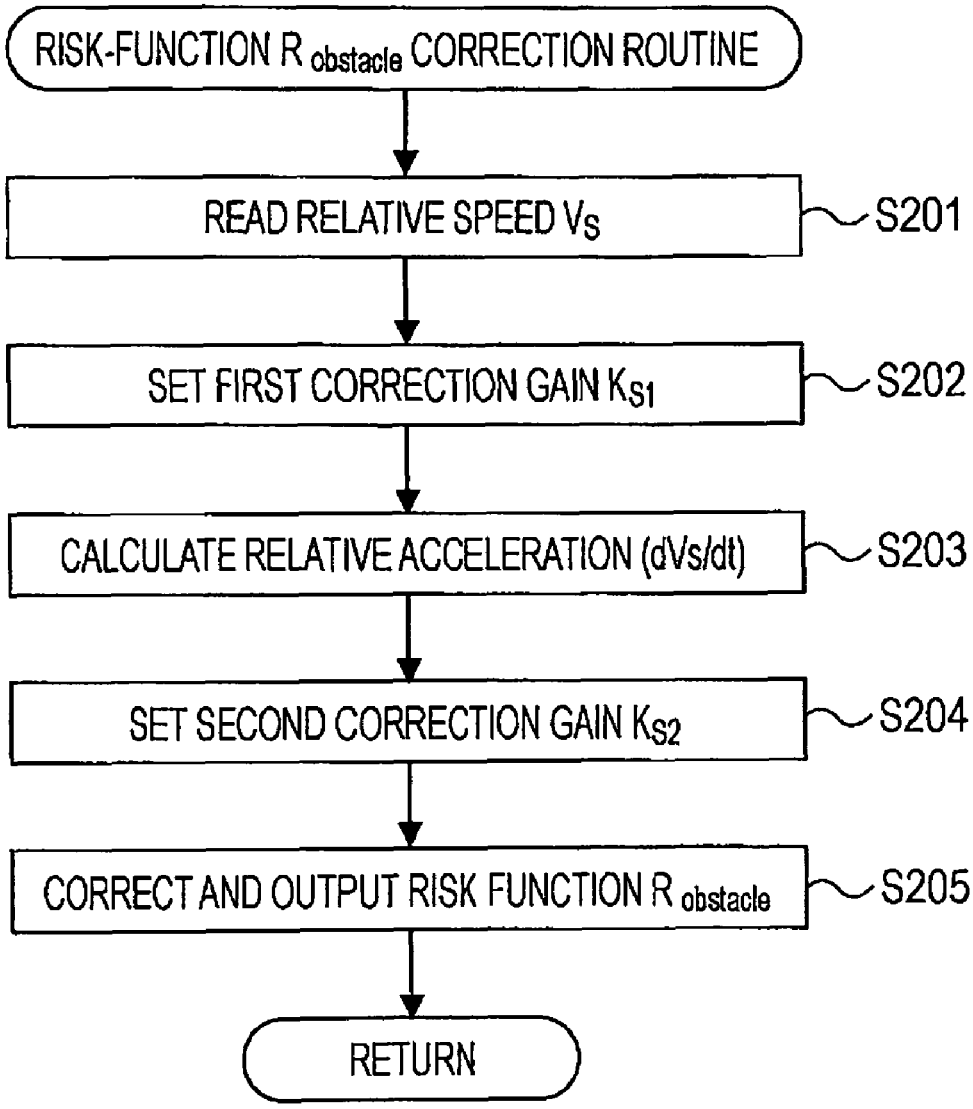
FIG. 4 is a flowchart showing a risk-function correcting routine.

In S104, the current risk function $R_{obstacle}$ calculated in S103 is corrected according to a risk-function ($R_{obstacle}$) correcting routine shown in FIG. 4.

In the risk-function ($R_{obstacle}$) correcting routine, first, a relative speed Vs of a target three-dimensional object with respect to the vehicle 1 is read in S201, and a first correction gain $K_{s1}$ is set with reference to a preset map (for example, a Vs-$K_{s1}$ characteristic map shown in FIG. 6A) in S202.

In S203, a relative acceleration (dVs/dt) is calculated from the relative speed Vs. In S204, a second correction gain $K_{s2}$ is set with reference to a preset map (for example, a (dVs/dt)-$K_{s2}$ characteristic map shown in FIG. 6B).

In S205, the risk function $R_{obstacle}$ is corrected by the following expression (3) and is output:

$$R_{obstacle}=K_{s1}\cdot K_{s2}\cdot R_{obstacle} \quad (3)$$

After that, the routine is exited.

Figure 6A:
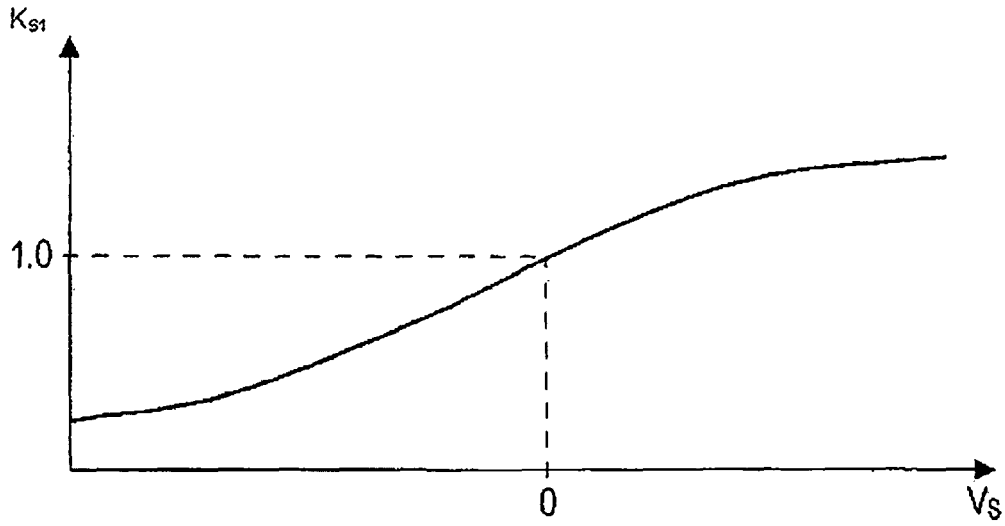
FIGS. 6A and 6B are characteristic views showing examples of correction coefficients in accordance with the relative speed and the relative acceleration.

In the Vs-$K_{s1}$ characteristic map shown in FIG. 6A, the first correction gain $K_{s1}$ is set to increase as the relative speed Vs increases. In particular, assuming that the first correction gain $K_{s1}$ is 1.0 when the relative speed Vs is 0 and the target object moves at the same speed as the speed of the vehicle 1, while the relative speed Vs exceeds 0 and the object approaches the vehicle 1, the first correction gain $K_{s1}$ exceeds 1.0. Consequently, the risk function $R_{obstacle}$ is corrected to a larger value, as is evident from the above-described expression (3). While the driver has a feeling of danger about an obstacle approaching the vehicle 1, he or she does not have a strong feeling of danger about an obstacle moving away from the vehicle 1. In consideration of this fact, the above-described setting is made. This setting allows the risk function $R_{obstacle}$ to be set more naturally.

Figure 6B:
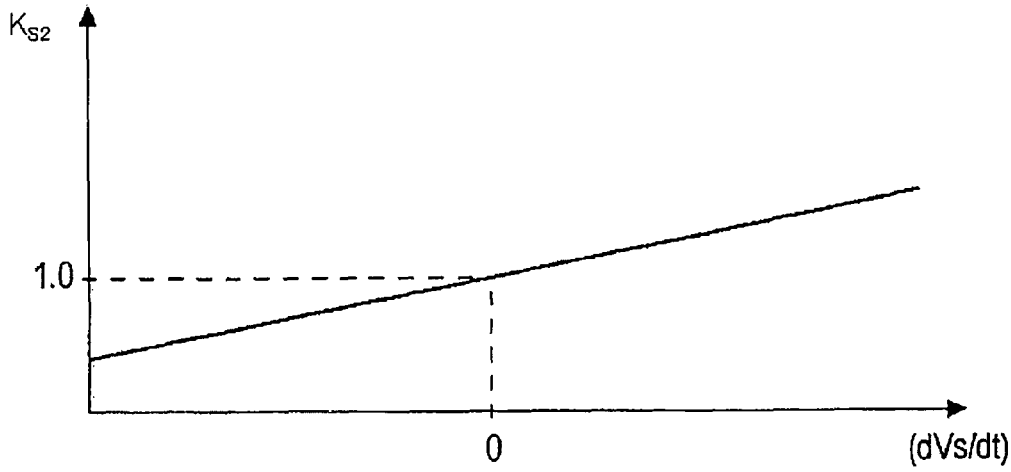

In the (dVs/dt)-$K_{s2}$ characteristic map shown in FIG. 6B, the second correction gain $K_{s2}$ is set to increase as the relative acceleration (dVs/dt) increases. In particular, assuming that the second correction gain $K_{s2}$ is 1.0 when the relative acceleration (dVs/dt) is 0 and the target object does not accelerate relative to the vehicle 1, when the relative acceleration (dVs/dt) exceeds 0 and the object decelerates or rapidly decelerates, the second correction gain $K_{s2}$ exceeds 1.0. Consequently, the risk function $R_{obstacle}$ is corrected to a larger value, as is evident from the above-described expression (3). While the driver has a feeling of danger about an obstacle approaching the vehicle 1 while decelerating or rapidly decelerating, he or she does not have a strong feeling of danger about an obstacle accelerating and moving away from the vehicle 1. In consideration of this fact, the above-described setting is made. This setting allows the risk function $R_{obstacle}$ to be set more naturally.

Referring again to FIG. 2, in S105, the current total risk function R is calculated by the following expression (4):

$$R=R_{line}+R_{obstacle} \quad (4)$$

In S106, a position ($x_{obstacle}(t)$, $y_{obstacle}(t)$) of the three-dimensional object taken after t seconds is estimated by the following expression (5):

$$(x_{obstacle}(t), y_{obstacle}(t))=(x_{obstacle}+v\,x_{obstacle}\cdot t,\ y_{obstacle}+v\,y_{obstacle}\cdot t) \quad (5)$$

In S107, the position ($x_{obstacle}(t)$, $y_{obstacle}(t)$) of the three-dimensional object taken after t seconds, which is estimated in S106, is substituted for x and y in the total risk-function R calculated in S105, thereby setting a total risk function $R(x_{obstacle}(t), y_{obstacle}(t))$ after t seconds.

In S108, the total risk function $R(x_{obstacle}(t), y_{obstacle}(t))$ after t seconds, which is calculated in S107, is partially differentiated in the width direction (y direction). From a point where the obtained value is 0, a minimum $y_{min}(x,t)$ in the width direction (y direction) is calculated. In other words, at the minimum, the following condition is satisfied:

$$\partial R(x_{obstacle}(t), y_{obstacle}(t))/\partial y=0 \quad (6)$$

In S109, a vehicle position (X(t), Y(t)) after t seconds is estimated by the following expression (7):

$$(X(t), Y(t))=(V\cdot t,\ V\cdot\int \sin\phi(\tau)d\tau;\ \text{integral range } 0\leqq\tau\leqq t) \quad (7)$$

where $\phi(t)$ represents the yaw rate of the vehicle 1. The yaw rate is given by the following expression (8):

$$\phi(t)=(d\phi/dt)\cdot t+(1/2)\cdot((d^2\phi/dt^2)+(u(t)/Iz))\cdot t^2 \quad (8)$$

where Iz represents the yaw moment of inertia, and u(t) represents the above-described turning control amount serving as an additional yaw moment.

In S110, the above-described vehicle position (X(t), Y(t)) estimated in S109 is substituted for the minimum $Y_{min}(x,t)$ in the y direction calculated in S108, thereby calculating a minimum $y_{min}(X(t),t)$ at the vehicle position X(t).

In S111, an objective function J is obtained from a deviation between the lateral position Y(t) of the vehicle 1 and the minimum $y_{min}(X(t),t)$ and the turning control amount u(t) at each time. Then, a turning control amount u(t) that minimizes the objective function J is found at each time.

Figure 7A:
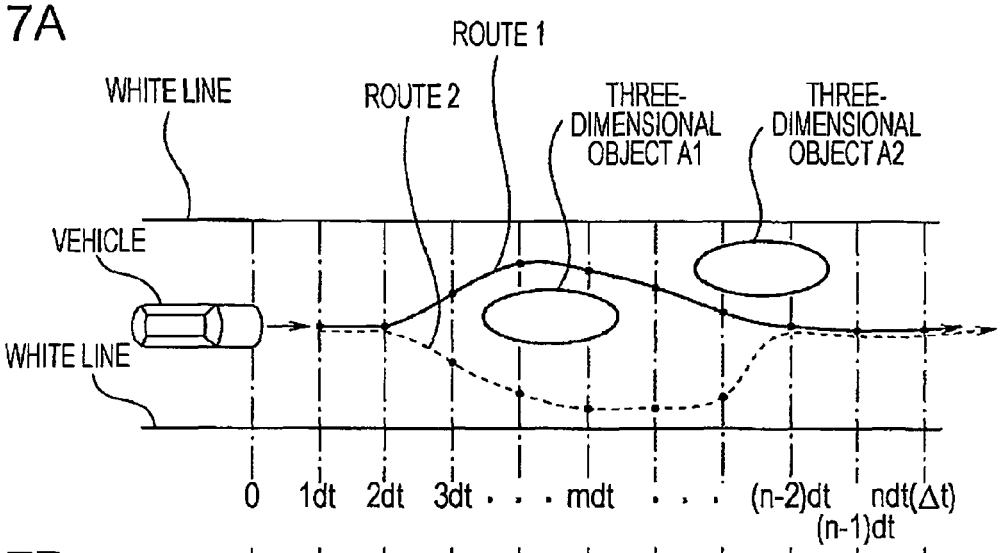
FIGS. 7A and 7B are explanatory views showing examples of a generated avoidance route and a turning control amount.
Figure 7B:
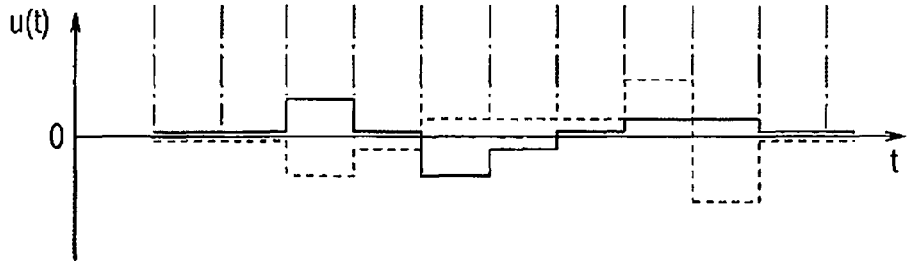

For example, as shown in FIGS. 7A and 7B, it is assumed that a range in which the vehicle 1 moves from a time 0 (present time) to Δt is designated as a target control region and the period from the time 0 to Δt is divided by dt into 1dt, 2dt, 3dt, . . . , mdt, . . . , (n−2)dt, (n−1)dt, and ndt (=Δt).

During a period from the time 0 to 1dt, for example, an objective function J0~1dt is set by the following expression (9), and a turning control amount u(0) that minimizes the objective function J0~1dt is found by known optimization calculation:

$$J0\sim 1dt=Wy\cdot(y_{min}(X(1dt),1dt)-Y(1dt))^2+Wu\cdot u(0)^2 \tag{9}$$

where Wy and Wu are preset weighting values.

During a period from 1dt to 2dt, for example, an objective function J1dt~2dt is set by the following expression (10), and a turning control amount u(1dt) that minimizes the objective function J1dt~2dt is found by known optimization calculation:

$$J1dt\sim 2dt=Wy\cdot(y_{min}(X(2dt),2dt)-Y(2dt))^2+Wu\cdot u(1dt)^2 \tag{10}$$

During a period from 2dt to 3dt, for example, an objective function J2dt~3dt is set by the following expression (11), and a turning control amount u(2dt) that minimizes the objective function J2dt~3dt is found by known optimization calculation:

$$J2dt\sim 3dt=Wy\cdot(y_{min}(X(3dt),3dt)-Y(3dt))^2+Wu\cdot u(2dt)^2 \tag{11}$$

Since there are two minimums at the time 3dt, two turning control amounts u(2dt) are obtained.

During periods after the time 3dt, similar objective functions are set and turning control amounts are found. During a period from (n−1)dt to ndt, for example, an objective function J(n−1)dt~ndt is set by the following expression (12), and a turning control amount u((n−1)dt) that minimizes the objective function J(n−1)dt~ndt is found by known optimization calculation:

$$J(n-1)dt\sim ndt=Wy\cdot(y_{min}(X(ndt),ndt)-Y(ndt))^2+Wu\cdot u((n-1)dt)^2 \tag{12}$$

Subsequently, in S112, a risk function R(t) of each route provided when the vehicle 1 moves by the turning control amount u(t) is set by the following expression (13):

$$R(t)=R_{line}+R_{obstacle} \tag{13}$$

Here, $R_{line}$ and $R_{obstacle}$ are values given by the above-described expressions (1) and (2) when the vehicle 1 moves by the turning control amount u(t) . These values are given by the following expressions:

$$R_{line}=K_{line}\cdot Y(t)^2 \tag{14}$$

$$R_{obstacle}=K_{obstacle}\cdot\exp(-((x_{obstacle}(t)-X(t))^2/(2\cdot\sigma x_{obstacle}^2))-((y_{obstacle}(t)-Y(t))^2/2\cdot\sigma y_{obstacle}^2)) \tag{15}$$

In S113, a final avoidance route R(t)f is selected from the risk functions R(t) of the routes set in S112.

More specifically, for each of the routes set in S112, the maximum value Rmax is found. The maximum value Rmax is expressed as follows:

$$R\max=\max(R(t))(0\leqq t\leqq\Delta t) \tag{16}$$

A route in which the maximum value Rmax is the smallest is selected as a final avoidance route R(t)f.

Cumulative risk values Rsum (=∫R(t)dt; integral range 0≦t≦Δt) may be found for the routes, and a route in which the value is the smallest may be selected as a final avoidance route R(t)f.

When only one route is set in S112, the route is set as a final avoidance route R(t)f in S113.

In the example shown in FIG. 7A, a route 1 shown by a solid line and a route 2 shown by a broken line are set in S112, and one of the routes 1 and 2, in which the maximum value Rmax is smaller or the cumulative risk value Rsum is smaller, is selected as a final avoidance route R(t)f in S113. Turning control amounts u(t) of the routes 1 and 2 are shown in FIG. 7B.

In S114, it is determined whether there is a region having a value more than or equal to a preset maximum allowable risk value Rlim (R(t)f≧Rlim) in the final avoidance route R(t)f. When such a region is not provided, a steering control command based on the turning control amount u(t) of the final avoidance route R(t)f is output to the automatic steering control device 23 in S117, and the program is escaped.

When it is determined in S114 that there is a region in which R(t)f≧Rlim, a brake start point Xbrake and a brake control time Tbrake are calculated in S115 on the basis of the earliest time when R(t)f≧Rlim.

Assuming that the earliest time when R(t)f>Rlim is Tm, the brake start point Xbrake is given by the following expression (17):

$$X\text{brake}=X(Tm)-Bx \tag{17}$$

where Bx represents a braking distance provided by a preset deceleration G. The braking distance Bx is given by the following expression (18):

$$Bx=(V^2/(2\cdot G))+Bx0 \tag{18}$$

where Bx0 represents a preset distance to an obstacle at the stop and is, for example, about 2 m.

The brake start time Tbrake is found by reverse calculation from the above-described brake start point Xbrake.

In S116, a brake control command based on the control start point Xbrake and the brake start time Tbrake is output to the automatic brake control device 22.

In S117, a steering control command based on the turning control amount u(t) of the final avoidance route R(t)f is output to the automatic steering control device 23, and the program is escaped.

As described above, according to the embodiment of the present invention, the current total risk functions R is set for each of target objects existing in front of the vehicle, such as white lines, guardrails, side walls, and three-dimensional objects. A temporal change in the total risk function R is predicted by predicting a temporal change in the position of the target object. On the basis of the temporal change in the total risk function R, a minimum $y_{min}(x,t)$ in the y-axis direction at the vehicle position is calculated for each timer. An objective function J at the time is obtained, and a turning control amount u(t) that minimizes the objective function J is calculated as a turning control amount u(t) of the vehicle 1. Then, a risk function R(t) provided when the vehicle 1 moves by the turning control amount u(t) is set for each route. A final avoidance route R(t)f is selected from the risk functions R(t)

of the routes. Steering is controlled on the basis of the turning control amount u(t) of the final avoidance route R(t)f, and braking is controlled on the basis of the values of the final avoidance route R(t)f. For this reason, it is possible to achieve collision avoidance control with consideration of not only an immediate risk, but also future risks.

When the current total risk functions R are set for white lines, guardrails, side walls, and three-dimensional objects existing in front of the vehicle, the current risks for the target objects are found as risk functions $R_{line}$ and $R_{obstacle}$. The current risk $R_{obstacle}$ for a three-dimensional object is corrected so as to increase as the relative speed Vs increases in a direction in which the three-dimensional object approaches the vehicle 1 and so as to increase as the relative acceleration (dVs/dt) increases in the direction in which the three-dimensional object approaches the vehicle 1. For this reason, it is possible to control the vehicle 1 to more naturally take an optimum route and to thereby improve safety while giving accurate consideration to the relative movement between the vehicle 1 and the obstacle.

While both brake control and steering control can be performed on the basis of the final avoidance route R(t)f in this embodiment, either brake control or steering control may be performed.

Brake control adopted in this embodiment is just exemplary. Another brake control, for example, closing the throttle and shifting to lower gears in an automatic transmission, may be performed in combination.

While an ambient environment is recognized on the basis of the image taken by the stereo camera 3 in this embodiment, it may be detected by a monocular camera, a millimeter-wave radar, or the like.

While the current total risk function R is set for each of white lines, three-dimensional objects, and the like existing in front of the vehicle 1 and a temporal change in the total risk function R is predicted in this embodiment, setting of the total risk function R and prediction of the temporal change thereof may also be performed for three-dimensional objects existing beside and on the rear side of the vehicle 1.

While an avoidance route is generated during advancing of the vehicle 1 in this embodiment, it may be generated during reverse traveling of the vehicle 1 by recognizing an environment on the rear side of the vehicle 1.

While the current risk $R_{obstacle}$ for a three-dimensional object is corrected in accordance with the relative speed Vs and the relative acceleration (dVs/dt) with respect to the vehicle 1 in this embodiment, correction may be made in accordance with only one of the relative speed Vs and the relative acceleration (dVs/dt).

What is claimed is:

1. A vehicle drive assist system comprising:

ambient-environment recognizing means for recognizing an ambient environment of a vehicle;

risk setting means for setting a current risk for an object in the recognized ambient environment;

risk-change predicting means for predicting a temporal change in risk by predicting a temporal change in a position of the object;

minimum calculating means for calculating a minimum of the risk at a position of the vehicle at each time on the basis of the predicted temporal change in the risk;

turning-control-amount calculating means for calculating a turning control amount of the vehicle on the basis of at least the minimum; and avoidance-route determining means for determining a final avoidance route by generating an avoidance route of the vehicle on the basis of the turning control amount, wherein the minimum calculating means calculates the minimum of the risk by partial differentiation in a width direction of the vehicle.

2. The vehicle drive assist system according to claim 1, further comprising at least one of:

steering control means for controlling steering on the basis of the turning control amount of the vehicle in the final avoidance route; and brake control means for controlling braking on the basis of the risk in the final avoidance route.

3. The vehicle drive assist system according to claim 1, wherein the turning-control-amount calculating means forms an objective function at each time on the basis of a deviation between a lateral position of the vehicle and the minimum and the turning control amount at the time, and calculates, as the turning control amount of the vehicle, a turning control amount that minimizes the objective function at the time.

4. The vehicle drive assist system according to claim 1, wherein, when the object is a white line, the risk setting means sets the risk so as to increase from about the center of a driving lane toward the white line.

5. The vehicle drive assist system according to claim 1, wherein, when the object is a three-dimensional object, the risk setting means sets the risk in a probability distribution.

6. The vehicle drive assist system according to claim 1, further comprising: risk correcting means for correcting the current risk set by the risk setting means in accordance with at least one of a relative speed and a relative acceleration between the object and the vehicle.

7. The vehicle drive assist system according to claim 6, wherein the risk correcting means corrects the current risk set by the risk setting means in accordance with the relative speed between the object and the vehicle so that the current risk increases as the relative speed increases in a direction in which the object approaches the vehicle.

8. The vehicle drive assist system according to claim 6, wherein the risk correcting means corrects the current risk set by the risk setting means in accordance with the relative acceleration between the object and the vehicle so that the current risk increases as the relative acceleration increases in a direction in which the object approaches the vehicle.

* * * * *